US007865984B2

(12) United States Patent
Merritt

(10) Patent No.: US 7,865,984 B2
(45) Date of Patent: Jan. 11, 2011

(54) SAFE STORE OXYGEN BOTTLE HOLDER

(75) Inventor: Justen Harlow Merritt, Camas, WA (US)

(73) Assignee: Pedigo Products, Inc., Vancouver, WA (US)

( * ) Notice: Subject to any disclaimer, the term of this patent is extended or adjusted under 35 U.S.C. 154(b) by 535 days.

(21) Appl. No.: 11/873,947

(22) Filed: Oct. 17, 2007

(65) Prior Publication Data

US 2008/0189858 A1 Aug. 14, 2008

Related U.S. Application Data

(60) Provisional application No. 60/889,207, filed on Feb. 9, 2007.

(51) Int. Cl.
*A47C 21/00* (2006.01)
*A47B 73/00* (2006.01)

(52) U.S. Cl. ..... 5/503.1; 5/658; 211/74

(58) Field of Classification Search ..... 5/503.1, 5/658, 625; 211/74; 296/20
See application file for complete search history.

(56) References Cited

U.S. PATENT DOCUMENTS

| | | | | | |
|---|---|---|---|---|---|
| 3,761,968 | A * | 10/1973 | Besler | 5/503.1 |
| 5,259,372 | A * | 11/1993 | Gross et al. | 128/200.24 |
| 7,484,252 | B2 * | 2/2009 | Wang | 5/81.1 C |
| 2007/0251004 | A1 * | 11/2007 | Wang | 5/81.1 R |
| 2008/0189858 | A1 * | 8/2008 | Merritt | 5/503.1 |

* cited by examiner

*Primary Examiner*—Robert G Santos
(74) *Attorney, Agent, or Firm*—Davis Wright Tremaine LLP

(57) ABSTRACT

An apparatus includes a mounting bracket configured to be secured to an underside of a litter. A storage basket is configured to engage ends and sides of a bottle. A movable mechanism couples the storage basket to the mounting bracket, the mechanism being configured for allowing the storage basket to be lowered away from the litter to provide access to the bottle, and allowing the storage basket to be secured against the underside of the litter to restrict movement of the bottle. A latch system is also included to hold the storage basket secured to the underside of the litter. The storage basket is automatically leveled by the movable mechanism when it is lowered away from the litter.

20 Claims, 8 Drawing Sheets

SAFE STORE OXYGEN BOTTLE HOLDER

RELATED APPLICATION

This utility patent application claims the benefit under 35 United States Code §119(e) of U.S. Provisional Patent Application No. 60/889,207 filed on Feb. 9, 2007, which is hereby incorporated by reference in its entirety.

BACKGROUND

Medical patients being transported on stretchers or gurneys sometimes require oxygen that may be supplied from a bottle of compressed oxygen. To avoid having to separately carry or roll the oxygen bottle along with the stretcher, the oxygen bottle may be mounted directly on the stretcher holding the patient.

Mounting the oxygen bottle on a stretcher may be difficult for several reasons. For example, because each oxygen bottle holds a limited supply of oxygen, the oxygen bottle must be mounted in a non-permanent manner to allow medical staff to replace the bottle as needed. The base of the stretcher may provide a location with sufficient clearance to allow the oxygen bottle to be changed. Unfortunately, the person trying to change the oxygen bottle will have to bend over to access that location and, considering the appreciable weight of both full and empty oxygen bottles, bending to lift the oxygen bottles is undesirable. On the other hand, mounting the oxygen bottle at another location on the stretcher that would be more convenient for changing the bottle may leave the valve of the bottle exposed where it may be bumped or damaged.

SUMMARY OF THE INVENTION

This Summary is provided to introduce a selection of concepts in a simplified form that are further described below in the Detailed Description. This Summary is not intended to identify key features or essential features of the subject matter to be claimed, nor is it intended to be used as an aid in determining the scope of the subject matter to be claimed.

The present disclosure is directed to an apparatus that may be used to hold a bottle that can be mounted on a stretcher. The apparatus includes a mounting bracket configured to be secured to an underside of a litter. A storage basket is configured to engage ends and sides of a bottle. A movable mechanism couples the storage basket to the mounting bracket, the mechanism being configured for allowing the storage basket to be lowered away from the litter to provide access to the bottle, and allowing the storage basket to be secured against the underside of the litter to restrict movement of the bottle. A latch system is also included to hold the storage basket secured to the underside of the litter.

A system includes a stretcher with a litter portion for carrying a patient. The system also includes a storage basket for carrying a bottle. A mechanical coupling device is included that couples the storage basket to the litter portion, wherein a first portion of the mechanical coupling device is coupled to the litter portion and a second portion of the mechanical coupling device is coupled to the storage basket, and wherein the mechanical coupling device allows movement of the storage basket relative to the litter portion to increase bottle accessibility.

A method of releasing a storage basket coupled to a mounting portion on a stretcher includes unlatching a latch that engages a crossbar of the storage basket. The storage basket is then lowered away from the stretcher, wherein an upper portion of the storage basket is opened such that the storage basket may be accessed when the storage basket is lowered away from the stretcher. The motion of the storage basket is dampened as it is lowered away from the stretcher.

These and other features and advantages will be apparent from reading the following detailed description and reviewing the associated drawings. It is to be understood that both the foregoing general description and the following detailed description are explanatory only and are not restrictive. Among other things, the various embodiments described herein may be embodied as methods, devices, or a combination thereof. The disclosure herein is, therefore, not to be taken in a limiting sense.

BRIEF DESCRIPTION OF THE DRAWINGS

In the drawings, like numerals represent like elements. In addition, the first digit in the reference numerals refers to the figure in which the referenced element first appears.

DETAILED DESCRIPTION OF EMBODIMENTS

This detailed description describes embodiments of a bottle holder. Generally, a movable storage basket is secured to the litter of a stretcher. In a storage position, the bottle is held in place by both the storage basket and the underside of the litter. A release mechanism is provided that allows a user to lower the bottle into an access position. Once in the access position, the storage basket is in a position where the underside of the litter no longer constrains the position of the bottle. Thus, in the access position the bottle may easily be changed by a user. The storage basket may then be raised back into the storage position in which the bottle is secured to the stretcher for use in moving a patient.

Figure 1:
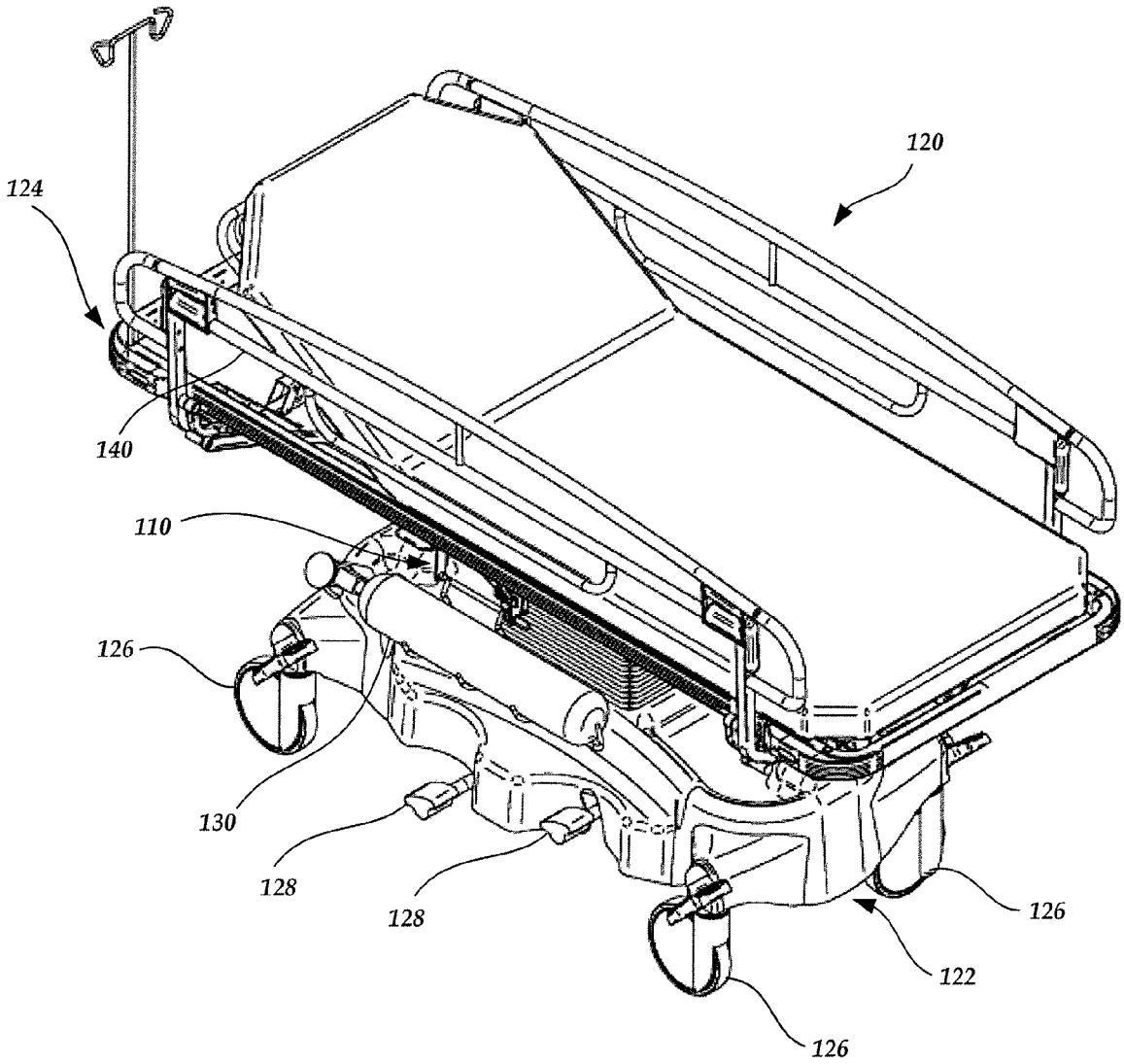
FIG. 1 is a diagram illustrating an embodiment of a stretcher equipped with an embodiment of a bottle holder.

FIG. 1 shows an embodiment of a bottle holder 110 supporting a bottle 130. The bottle holder 110 is configured to be attached to a patient stretcher 120. The patient stretcher 120 includes a base 122 and a litter 124. The litter 124 provides a surface for carrying a patient. The patient stretcher 120 may also include an adjustable side rail 140 that may be raised and lowered to facilitate movement of patients on and off of the litter 124. The base 122 includes casters 126 and controls 128. The casters 126 allow the patient stretcher 120 to be rolled. The controls 128 allow a user, such as a hospital staff member, to control the position and orientation of the litter 124. For example, the controls 128 allow a user to raise or lower the height of the litter 124. The controls 128 may also allow the user to change the angle of the litter 124 relative to the base 122 to place the litter in a Trendelinberg or a reverse-Trendelinberg position.

Figure 2C:
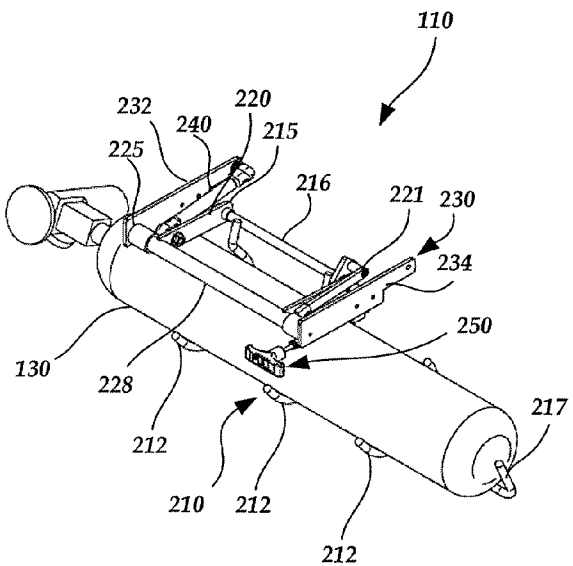
FIGS. 2A-2C are perspective views illustrating an embodiment of a bottle holder.
Figure 2B:
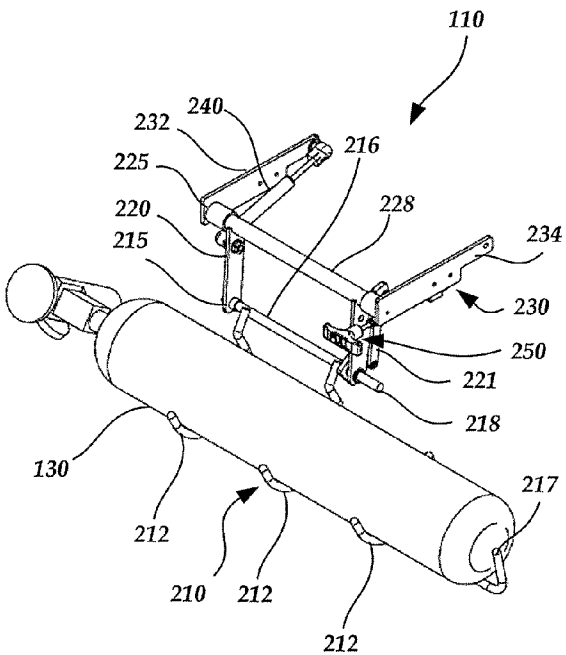
Figure 2A:
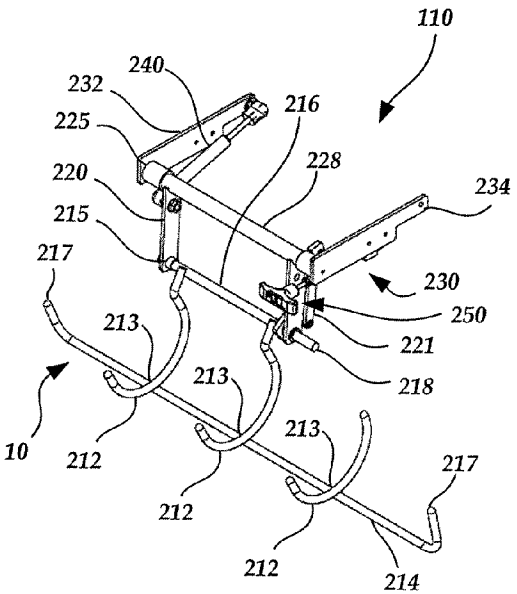

FIG. 2A shows an illustration of the bottle holder 110 in an access position with the bottle removed. The bottle holder 110 includes a storage basket 210 rotatably received in a pair of moveable swing arms 220 and 221 within a pair of first joints 215. The swing arms 220 and 221 are coupled to an upper cross bar 228 that is rotatably received within a pair of second joints 225 within mounting brackets 232 and 234 of a mounting assembly 230. The mounting brackets 232 and 234 of the mounting assembly 230, in turn, are configured to be attached to the litter (not shown in FIG. 2A). In the access position of FIG. 2A, the storage basket 210 is lowered away from the litter to facilitate replacement of the bottle. As will be further described below with references to FIG. 2C, when the storage basket 210 is moved into a storage position, the storage basket 210 secures the bottle against an underside of the litter to keep the bottle in place. The storage basket 210 is secured in the storage position using a latch system 250, which is described in greater detail with reference to FIG. 4.

In the embodiment shown in FIG. 2A, the storage basket 210 includes transverse elements 212 and one or more lateral elements 214. The transverse elements 212 include curved wire frame elements configured to receive the cylindrical shape of the bottle (not shown in FIG. 2A). The lateral elements 214 include wire frame elements configured to run along the length of the bottle to provide rigidity to the transverse elements 212 in supporting the bottle. In one embodiment, the transverse elements 212 and the lateral elements 214 are welded together at intersecting joints 213. In addition, in one embodiment, the lateral elements have angled end sections 217 configured to engage ends of the cylindrical bottle to help prevent the bottle from sliding within the storage basket 210.

The storage basket 210 also includes a lower cross bar 216 that, in the embodiment of FIG. 2A, are joined to a portion of the transverse elements 212 of the storage basket 210. The lower cross bar 216 is rotatably received within the pair of first joints 215 within the swing arms 220 and 221. As also described in more detail below, a portion of the lower cross bar 216 may extend through one of the first joints 215 through one of the swing arms 220 and 221 and function as a latch pin 218, the operation of which is further described below. In FIG. 2A, the portion of the lower cross bar 216 forming the latch pin 218 extends through the first joint 215 of a second swing arm 221.

In other embodiments, the storage basket 210, including the transverse elements 212, the lateral elements 214, and the lower cross bar 216 may be formed as a unitary element comprised of a rigid and/or semi-rigid material, such as plastic, stainless steel, cold rolled steel or any other suitable material. In order to reduce corrosion where cold rolled steel or another non-stainless material is used, the storage basket 210 may be coated with a rubber or powder coating. This coating may be painted or colored as desired. For example, in embodiments configured to carry an oxygen bottle, the storage basket 210 may be presented in the same dark green that is commonly used to paint oxygen bottles.

Although the embodiment of the storage basket 210 shown in FIG. 2A employs a wire frame design with three transverse elements 212, one lateral element 214, and a lower cross bar 216, the storage basket 210 may also be composed of any number of elements. The greater the number of elements used, the more rigid the storage basket 210 may be. Conversely, rather than employing an open wire frame design consisting of a plurality of joined members, the storage basket 210 may be composed of a closed tubular design such as a hollow cylindrical, or partially cylindrical, sleeve. However, increasing the number of elements—and thereby increasing the number of joints 117 between the members 212 and 214—or using a closed sleeve design may increase the difficulty in keeping the storage basket 210 clean. With more joints 117 between elements, there are more places where debris may become lodged; similarly, with a closed sleeve, debris or moisture may easily become trapped between the sleeve and a bottle stored in such a closed basket.

To provide the ability to move the storage basket 210 between an access position (FIGS. 2A and 2B) and a storage position (FIG. 2C), the storage basket 210 is both rotated and translated upwardly toward an underside of the litter (not shown in FIG. 2A). In one embodiment, the storage basket 210 is rotatably received in the first joints 215 of the movable swing arms 220 and 221. The storage basket 210 thus can be rotated about an axis of the lower cross bar 216, the ends of which are rotatably received in the first joints 215 of the movable swing arms 220 and 221.

The movable swing arms 220 and 221, which rotatably receive the lower cross bar 216 of the storage basket 210, are coupled with an upper cross bar 228 that is rotatably received by second joints 225 within the mounting brackets 232 and 234 of the mounting assembly 230. In moving the storage basket 210 upward, the storage basket 210 rotates in one direction relative to the movable swing arms 220 and 221, while the movable swing arms 220 and 221 rotate in an opposite direction about the upper cross bar 228, effectively collapsing the movable swing arms 220 and 221 inside the mounting bracket 230. In other words, the movable swing arms 220 and 221 folds into the plane of the mounting bracket 230 as a function of the relative rotations at the ends of the movable swing arms 220 and 221, allowing the storage basket 210 to be drawn against the underside of the litter.

In one embodiment, a damper 240 is coupled between a first mounting bracket 232 and the first movable swing arm 220. The damper 240 provides resistance to slow the rotation of the first swing arm 220. In the embodiments of FIGS. 2A-2C, the damper 240 is in the nature of an extensible, pneumatic damping cylinder. In other embodiments, the damper 240 may be comprised of a gas shock, a spring, a counterweight mechanism or any other suitable resistance device.

In one embodiment, the second mounting bracket 234 of the mounting assembly 230 supports a latch system 250 configured to receive the latch pin 218 of the lower cross bar 216 to secure the storage basket 210 in place. The operation of the latch system 250 is described in more detail below with reference to FIG. 4.

FIG. 2B shows the bottle holder 110 in an access position with the bottle 130 in place. Again, in the access position, the storage basket 210 is lowered away from the underside of the litter portion of the stretcher (not shown in FIG. 2B). Because the underside of the litter provides the primary mode of upward movement confinement for the bottle 130, once the bottle 130 is no longer in proximity to the litter, the bottle 130 may be free to move in the upward direction. Thus, the bottle 130 becomes accessible and the user may remove it when the position of the bottle 130 relative to the litter is changed.

FIG. 2C shows an embodiment of the bottle holder 110 in a storage position supporting the bottle 130 in a secure, stored position. In the stored position, the storage basket 210 is repositioned upward toward the underside of the litter (not shown in FIG. 2C). When the bottle holder 110 is in the storage position, it will be difficult for a user to remove or replace the bottle 130. On the other hand, when the bottle holder 110 is in the access position, as shown in FIG. 2B, the bottle 130 can be changed with relative ease. It should be noted that, because the bottle holder 110 is secured to the underside of the litter rather than a base of the stretcher (not shown in FIG. 2C), a person seeking to remove, install, or replace the bottle 130 need not bend down to the ground to perform the task. Instead, that person need only reach to the level of the storage basket 210 which is positioned just below the underside of the litter. When the bottle holder 110 is in the storage position shown in FIG. 2C, the bottle 130 is held secured in every direction. The bottle 130 is supported from below by the transverse elements 212 and/or the lateral elements 214, depending on the configuration of the storage basket. The bottle 130 may be also be secured from moving laterally relative to the main axis of the bottle 130 by the curvature the transverse elements 212 engaging the curved sides of the bottle 130. The bottle 130 is secured from sliding along the main axis of the bottle by the raised end portions 217 engaging end portions of the bottle 130. Finally, the bottle 130 is secured from moving in an upward direction and leaving the basket—such as may result from an impact to the stretcher (not shown in FIG. 2C) or the stretcher moving over rugged or uneven terrain—by the underside of the litter.

The bottle holder 110 is designed to secure the position of the bottle when the stretcher (not shown) and, therefore, bottle holder 130 is tilted. The stretcher may become tilted when moving over uneven terrain or when moving up or down an inclined surface, such as a hill or a ramp. The stretcher may also become tilted when the angle of the litter 124 is adjusted by manipulation of the controls 128. For example, when the front of the litter 124 is elevated in a reverse-Trendelinberg position, the front of the bottle holder 110 is also elevated and the weight of the bottle 130 exerts a force that pushes the bottle 130 laterally to the lower end of the storage basket 210. When the angle of the bottle holder 110 changes, however, the raised ends 217 of the lateral elements 214 engage the end portions of the bottle 130 to prevent the bottle 130 from sliding out of the storage basket 210 and, thus, out of the bottle holder 110.

In various embodiments, the bottle holder 110 may be mounted on numerous portions of the stretcher (not shown in FIGS. 2A-2C). As has been described, in some embodiments, the bottle holder 110 is mounted on the litter 124. Mounting the bottle holder 110 on the litter allows the bottle holder 110 to move with the litter. Thus, for example, if the litter is raised or lowered, the bottle holder 110 also will be raised or lowered. This allows the position of the bottle holder to remain constant relative to the position of the patient resting on the litter, and thus reduces the length of hoses needed to supply air from the bottle 130 to the patient. Further, because the hoses need not be lengthened to account for relative motion between the patient and the bottle 130, there is not slack in the hoses that might result in the hoses becoming tangled or kinked, or being kicked or pulled. Additionally, mounting the bottle holder 110 on the litter allows the bottle holder 110 to be raised and lowered using the stretcher's own hydraulics that control the position of the litter.

The bottle holder 110 may also be mounted in various orientations on the litter. In some embodiments, the bottle holder 110 may be mounted parallel with the front or rear edges of the litter, or the bottle holder 110 may be mounted parallel with the sides of the stretcher. When the bottle 130 used is as long or longer than the ends of the stretcher, however, mounting the bottle holder 110 parallel with the ends of the stretcher may result in one or more ends of the bottle protruding from under the litter. This results in a potential hazard to the bottle 130, as well as persons standing or working near the stretcher. Thus, it may often be advantageous to mount the bottle holder 110 along one of the sides of the stretcher, so that the longest dimension of the bottle is parallel to the longest dimension of the stretcher, as shown in FIG. 1.

In one embodiment of the bottle holder 110, it is desirable to maintain the angular position of the storage basket 210 (FIGS. 2A-2C) relative to the main axis of the bottle 130. Maintaining the angular orientation of the storage basket 210 helps to ensure that the lateral members 212 of the storage basket 210 continue to engage the bottle 130 to prevent the bottle 130 from rolling out of the bottle holder. To maintain the angular position of the storage basket 210, a multi-segmented arm assembly used as one or both of the moveable swing arms 220 and 221 will, in effect, automatically level the position of the storage basket 210.

Figure 3:
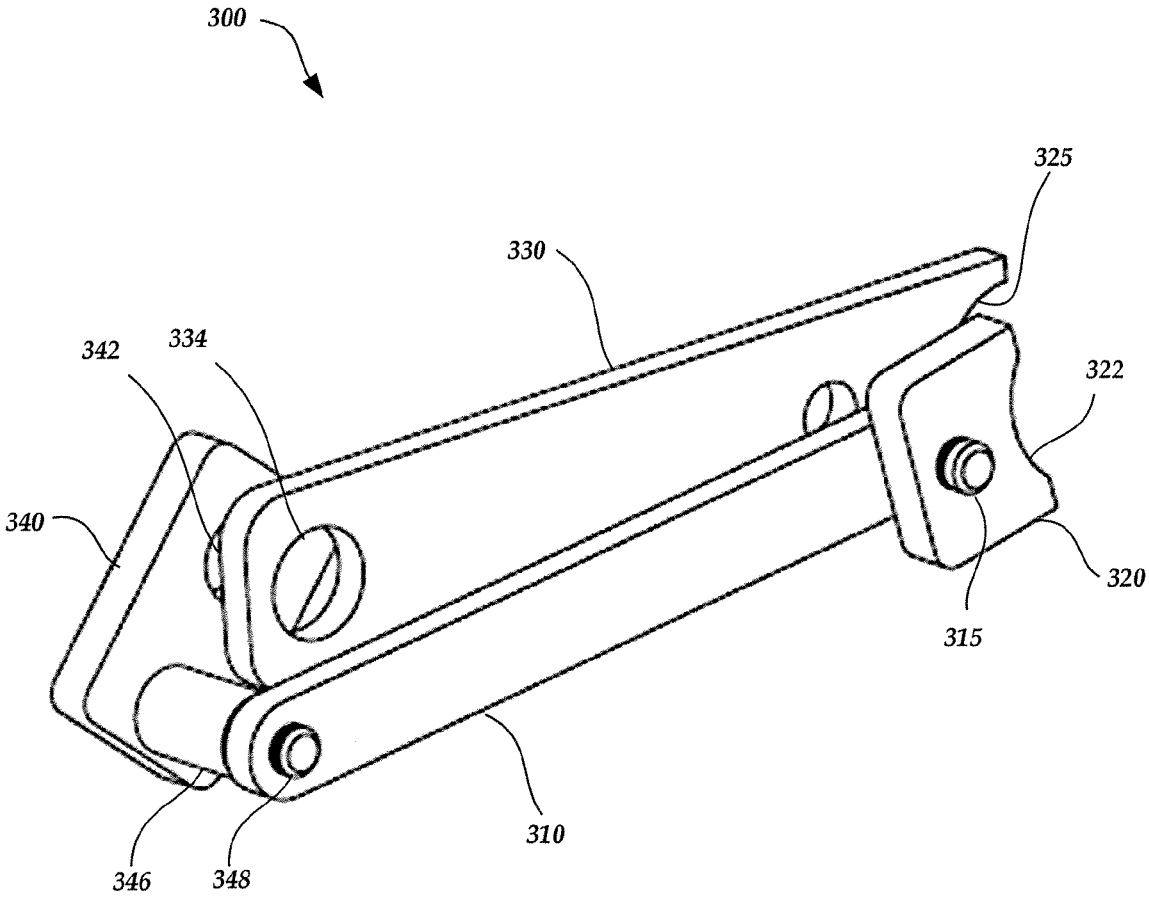
FIG. 3 is a diagram illustrating an embodiment of an arm assembly that facilitates movement of the storage basket.

FIG. 3 shows an embodiment of a multi-segmented arm assembly 300 used as one or both of the two movable swing arms 220 and 221 (FIGS. 2A-2C). In the embodiment of FIGS. 2A-2C, the arm assembly 300 is used as the second swing arm 221, thereby connecting the lower cross bar 216 of the storage basket 210 to the second mounting bracket 334.

As illustrated in FIG. 3, the arm assembly 300 includes four linkages: a first linkage 310, a second linkage 320, a third linkage 330 and a fourth linkage 340. The first linkage 310 is rotationally coupled to the second linkage 320 at a first joint 315. The second linkage 320 may be secured to the second mounting bracket 234 of the mounting assembly 230 at an edge 322. The edge 322 may, for example, be welded to the second mounting bracket 234 to prevent movement of the second linkage 320 relative to the second mounting bracket 234 and, in turn, the litter 124. The third linkage 330 may be secured to the upper cross bar 228 at an edge 325. The edge 325 may, for example, be welded to the upper cross bar 228 to prevent movement of the third linkage 330 relative to the upper cross bar 228.

The third linkage 330 also may be effectively rotationally coupled to the fourth linkage 340. The third linkage 330 includes a first socket 334, and the fourth linkage 340 includes a second socket 342, both of which can receive a cylindrical member (not shown) about which both can rotate. In one embodiment, the first socket 334 and the second socket 342 receive the lower cross bar 216 (FIGS. 2A-2C), thereby coupling both the third linkage 330 and the fourth linkage 340. The second socket 342, however, may be secured to the lower cross bar 216. For example, the lower cross bar 216 that is received through the second socket 342 may be welded to the fourth linkage 340 at the second socket 342 to prevent movement of the fourth linkage 340 relative to the lower cross bar and, in turn, the storage basket 210. In receiving the lower cross bar 216, the storage basket 210 is thereby joined to the arm assembly 300.

The fourth linkage 340 may include a coupling portion 346 that is secured to the fourth linkage 340. The coupling portion 346 allows the fourth linkage 340 to couple to the first linkage 310. More specifically, the fourth linkage 340 may be rotatably coupled to the first linkage 310 through the coupling portion 346 at a fourth joint 348. The fourth joint 348 thus allows rotation between the fourth linkage 340 and the first linkage 310.

The arm assembly 300 restrains the orientation of the storage basket 210 (FIGS. 2A-2C) as it moves. The storage basket 210 is coupled to the arm assembly 300 (as the second swing arm 221), and the arm assembly 300 is coupled to the litter 124 (FIG. 1) through the second mounting bracket 234. The angular orientation of the storage basket relative to the litter 124 is controlled by the angle of the fourth linkage 340 relative to the second mounting bracket 234, which is fixed to the litter 124. The angle of the fourth linkage 340 relative to the second mounting bracket 234 is in turn dictated by the relative locations of the two joints to which the fourth linkage 340 mounts: the second socket 342 rotationally coupled to the first socket 334 and the fourth joint 348. As the second arm assembly 300 rotates, the first linkage 310 and the third linkage 330 move at different rates because they do not share a common center of rotation. For example, the first linkage 310 rotates about the first joint 315 while the third linkage 330 rotates with the upper cross bar 228 about the second joints 225. Further, the length of the first linkage 310 may be different than the length of the third linkage 330. Thus, because the first linkage 310 and the third linkage 330 both rotate about different centers of rotation and are of different lengths, the relative locations of the second socket 342 and the fourth joint 348 vary as the arm assembly 300 rotates. As these joint positions vary, the angle of the fourth linkage 340 relative to the second mounting bracket 324 also varies, and thus causes the angle of the storage basket 210 relative to the litter 124 to vary.

The specific rate of rotation of the fourth linkage 340 relative to the second mounting bracket 234 may be controlled by the difference between the length of the first linkage 310 and the second linkage 330. This rate of rotation may also be controlled by the distance between their respective points of rotation; that is, the distance between the first joint 315 and the second joints 225. If such geometric factors are properly selected, the angle of the fourth linkage 340 relative to the second mounting bracket 234 remains constant as the second swing arm 221 rotates. Thus, the relative motion of the linkages cancels out the angular rotation storage basket 210 relative to the litter 124 as the storage basket 210 is raised and lowered. For example, because the storage basket may be coupled to the fourth linkage 340, and the second mounting bracket 234 may be coupled to the litter 124, the angle of storage basket 210 relative to the litter 124 may also remain constant through the rotation of the second swing arm 221. Thus, the four-linkage configuration of the second swing arm 221 may automatically level and maintain a constant orientation of storage basket 210.

Figure 4:
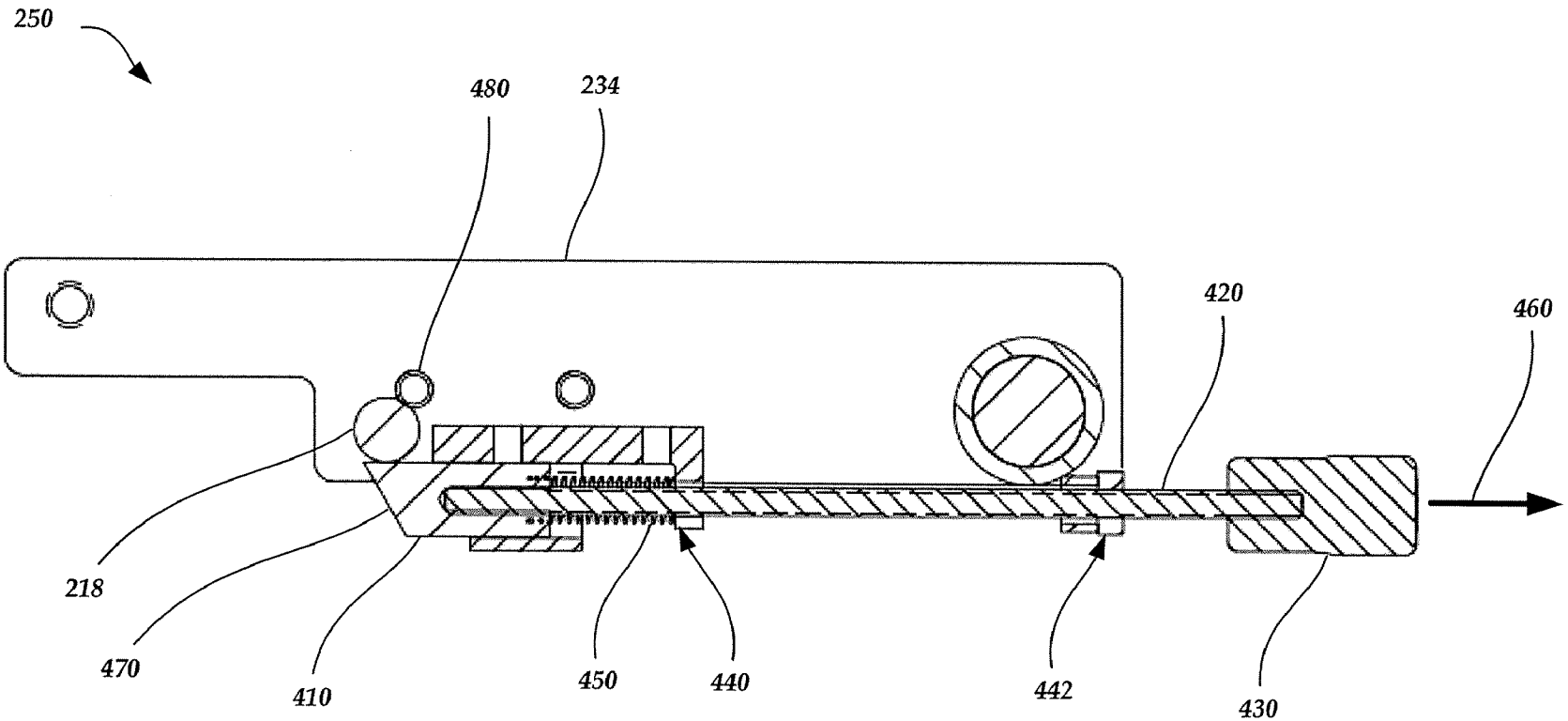
FIG. 4 is a diagram illustrating an embodiment of a latching system that secures the storage basket.

FIG. 4 shows an illustration of a latch system 250 associated with the second mounting bracket 234 (FIGS. 2A-2C) of the mounting assembly 230. The latch system 250, as mentioned previously, is used to secure the storage basket 210 in a storage position which, in turn, secures a bottle 130 received in the storage basket 210 in place. One embodiment of the latch system 250 supports a latched position and an unlatched position.

The latch system 400 includes a latch 410 that secures the latch pin 218 (FIGS. 2A-2B) so as to maintain the moveable swing arms (not shown in FIG. 4) in a folded position, thereby securing the storage basket (also not shown in FIG. 4) against an underside of the litter as previously described.

The latch 410 is coupled to a latch shaft 420 which, in turn, is coupled to a latch handle 430. The latch shaft 420 is slidably received within a plurality of guides 440 and 442. In the embodiment shown in FIG. 4, within a first guide 440, a spring 450 is disposed which maintains the latch system in the latched position shown. One end of the spring 450 is secured to the latch shaft 420 on an end toward the latch 410, while the opposite end of the spring presses against an inner surface of the first guide 440. The force exerted by the spring 450 between the latch shaft 420 and the first guide 440 maintains the latch system 250 remains in a latched position unless a sufficient force is applied by a user pulling the latch handle 440 in a direction 460 (represented by an arrow in FIG. 4) to compress the spring 450. When sufficient force is applied, the latch 410 is translated in the direction 460 such that the latch 410 moves away from beneath the latch pin 218, allowing the storage basket to be lowered away from the second mounting bracket 234 as previously described with reference to FIGS. 2A-2C.

Although the embodiment of the latch system 250 shown in FIG. 4 is manually released, it can automatically secure the storage basket (not shown in FIG. 4) in a storage position (FIG. 2C) when the storage basket is moved into the storage position. The latch 410 presents an angled surface 470 tapered to receive the latch pin 218 such that, when the latch pin 218 is forced upward, the latch pin 218 applies sufficient force to push the latch 410 in the direction 460 to allow the latch pin 218 to pass upward past the latch 410. Once the latch pin 218 is past an upper edge of the latch 410, where the latch pin 218 is secured against one or more stops 480 to prevent the latch pin from shifting, the force exerted by the spring 450 drives the latch 410 back in place. The latch system 250 remains in this position and secures the latch pin 218 and the storage basket 210 until a user releases the latch system as previously described.

Figure 5:
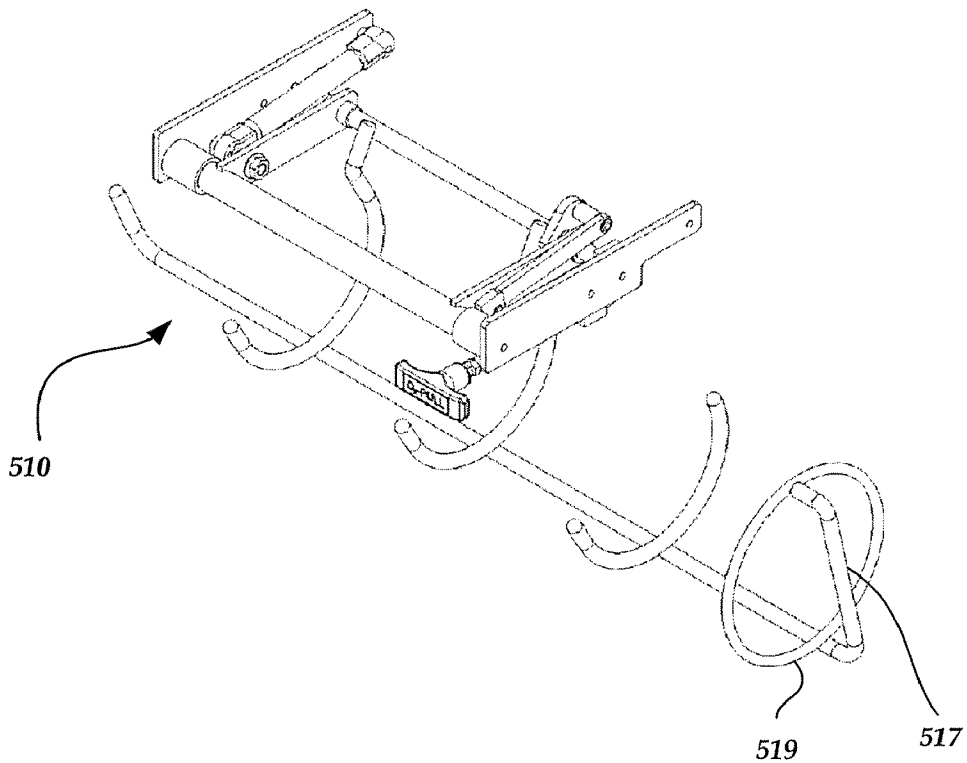
FIG. 5 is a diagram illustrating an alternative embodiment of a bottle holder.

FIG. 5 shows an illustration of an alternative embodiment of a storage basket 510 in a storage position. In this embodiment, the storage basket 510 includes an extended end section 517 and a protective ring 519. The extended end section 517 of the storage basket 510 is configured to provide further protection for the bottle 130. For example, an end of the bottle 130 may include a regulator that protrudes from the bottle and is sensitive to impact. When in an access position, the storage basket 510 may be susceptible to an impact from the side rail 140 of the stretcher 120 from above as the side rail 140 is lowered. The extended end section 517 and the protective ring 519 provide protection from impact from any direction by encircling the bottle 130. Accordingly, the bottle 130 may be protected from an impact from above when it is in either the stored or access position, independent of whether the stretch to which it is mounted includes a movable side rail 140.

In addition, as the ring 519 encircles the bottle 130, the ring 519 functions to reduce the likelihood that the transverse elements 212 of the storage basket 210 will become entangled with the side rail 140 of the stretcher 120. For example, as the side rail 140 may be configured to be raised and lowered, if the side rail 140 is lowered while the storage basket 210 is in an access position, the side rail 140 may become entangled with the transverse elements 212 of the storage basket 210. The ring 519 of the storage basket 510 therefore also provides a means for protecting the side rail 140 from being lowered into a position where it will interfere with the storage basket 410.

Figure 6:
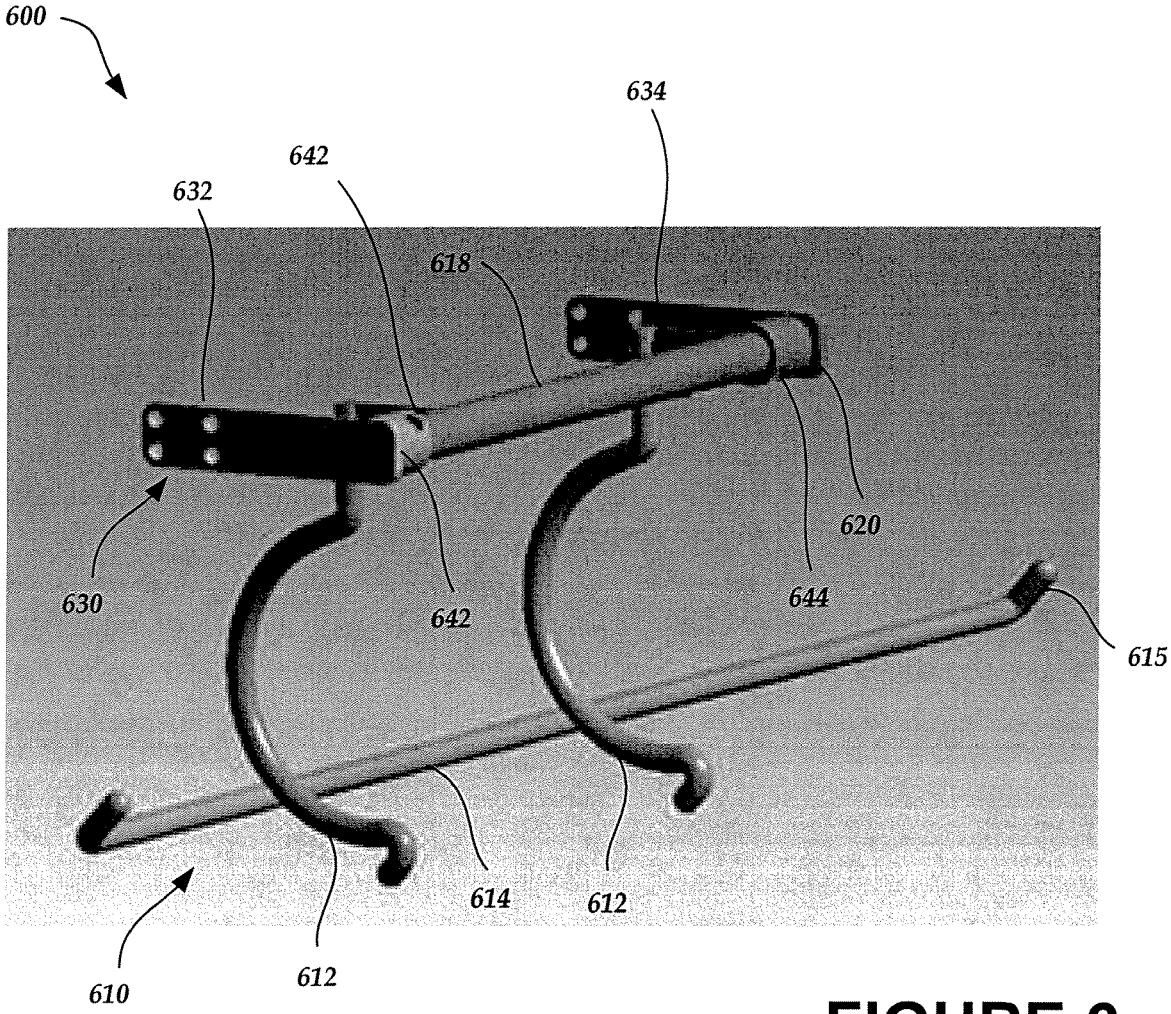
FIG. 6 is a flow diagram illustrating a process for presenting a bottle to a user for access.

FIG. 6 shows an alternative embodiment of a bottle holder 600. The bottle holder 600 includes a storage basket 610 that includes two curved transverse members 612 to engage the cylindrical surface of a bottle (not shown). The storage basket 610 also includes a lateral member 614 joined to the transverse members 612 to lend support to the transverse members 612. The lateral member 614 also has raised end portions 616 that engage ends of the bottle to help hold the bottle in place as described with regard to the previously described embodiment. The transverse members 612 are joined to a cross bar 618 that is rotatably received in a pair of joints 620 formed in a first mounting bracket 632 and a second mounting bracket 634 of a mounting assembly 630. The cross bar 618 includes one or more indexing notches 642 and 644 which may be disposed at similar or, as shown in FIG. 6, different angular orientations relative to the cross bar 618. The indexing notches 642 and 644 are used to secure the storage basket as described below.

The embodiment of FIG. 6 is shown in an access position to receive a bottle. Once the bottle is received in the storage basket 610, the bottle is fastened into the storage basket 610 by an additional fastening device (not shown). Because the bottle holder 600 does not control the angular position or otherwise automatically level the storage basket 610, when the storage basket 610 is moved in storage position, the storage basket 610 may rotate such that the bottle is able to roll out of the storage basket 610. Thus, an additional fastening device, such as a Velcro strap or rubber T-handle, may be used to secure a bottle in the basket 610. After the bottle is fastened into the storage basket 610, it is moved into a storage position in where the bottle is protectively located on the underside of a litter (not shown). Specifically, the storage basket 610 is rotated upward about the cross bar 618. When the cross bar 618 and the storage basket 610 reach a stored position, the indexing notch 644 passes over a spring loaded locking stud (not shown) supported by the joints 620. The locking stud extends into the indexing notch 644 to hold the cross bar 618 in place.

To release the storage basket 610 from a storage position and rotate the storage basket 610 into an access position, a user presses the locking studs back through the cross bar 618, thereby allowing the cross bar 618 and the storage basket 610 to rotate. As the cross bar 618 rotates downward and reaches the access positions, the indexing notch 642 passes over another spring loaded locking stud (not shown) supported by the joints 620. The locking stud extends into the indexing notch 642 to hold the cross bar 620 in place. To release the storage basket 610 from the access position and rotate the storage basket 610 upward back into the storage position, a user presses the locking stud back through the cross bar 618, thereby allowing the cross bar 618 and the storage basket 610 to rotate.

Figure 7:
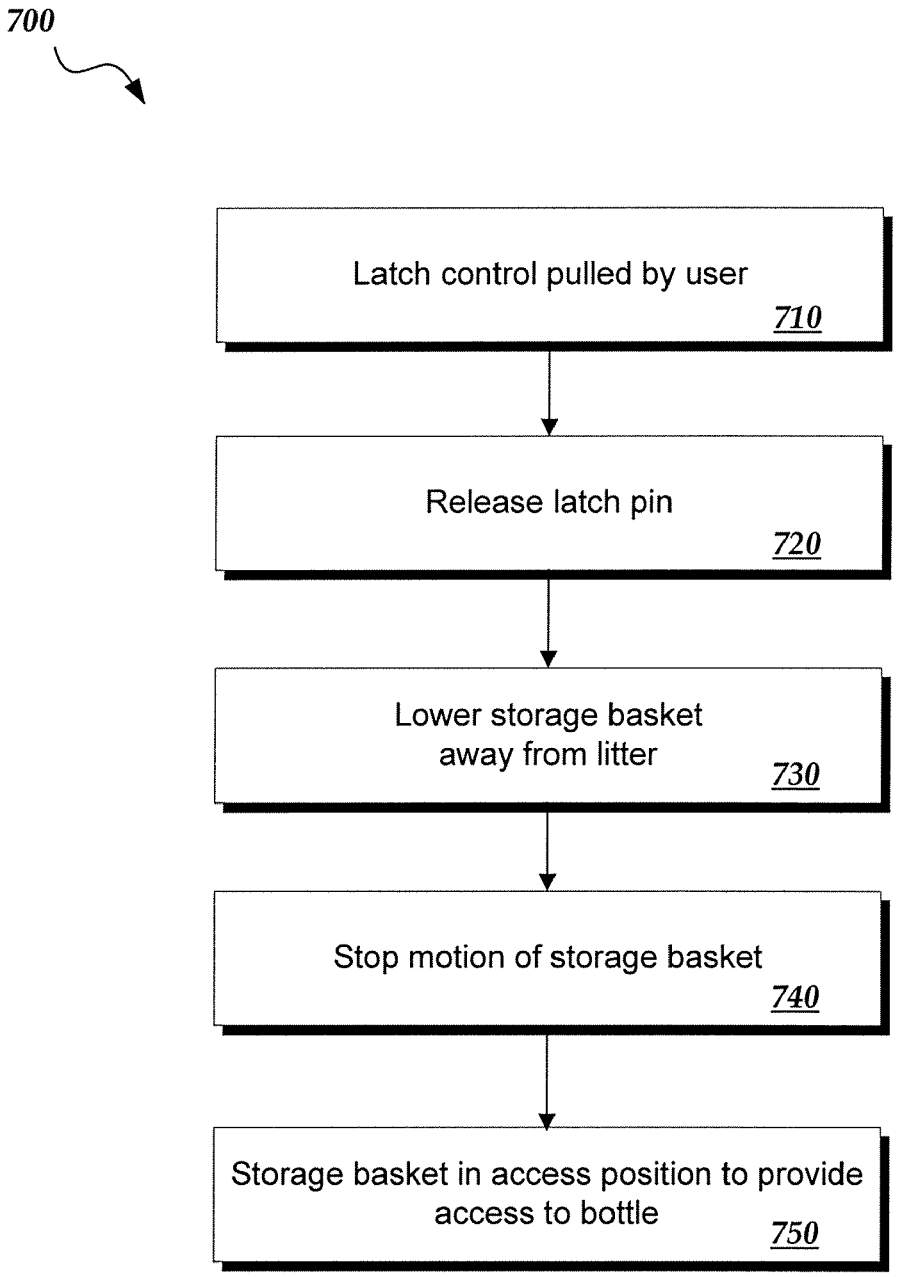
FIG. 7 is a flow diagram illustrating a process for storing a bottle.

FIG. 7 shows a flow diagram 700 of a process for accessing the bottle 130 when the bottle holder 110 (FIGS. 1, 2A-2C) is in the storage position shown in FIG. 2C. The flow diagram 700 of the method begins at 710. At 710, a latch handle 430 (FIG. 4) is pulled by a user. At 720, in response to the latch handle 430 being pulled by the user, the latch pin 218 is released. As previously described, pulling the latch handle 430 compresses the spring 450 and withdraws the latch 410 from beneath the latch pin 218.

Once the pin is released, at 730, the weight of the bottle 110 causes the storage basket 210 to move downward away from the litter 124. As previously described, the movement of the storage basket 210 may be controlled by a damper 240 and/or a plurality of multi-segmented arms 300. The damper 240 controls the rate of motion of the storage basket 210 and the bottle 110. During the lowering of the storage basket, one or more multi-segmented arms 300 maintain the storage basket 210 at a constant angle to the litter 124, preventing the bottle 250 from accidentally falling out of the storage basket 210.

Once the bottle 250 is lowered, at 740, the motion of the storage basket 210 is stopped. The motion of the storage basket 210 may be stopped, for example, by a limitation to the extension range of the damper 240. In other embodiments the motion may be halted by a mechanical stop, such as a pin, by movement limitations imposed by the geometry of linkages in a multi-segmented arm, or by other mechanisms. At 750, the storage basket 210 is presented in an access position, whereby the bottle 130 is presented to the user for easy removal of replacement.

Figure 8:
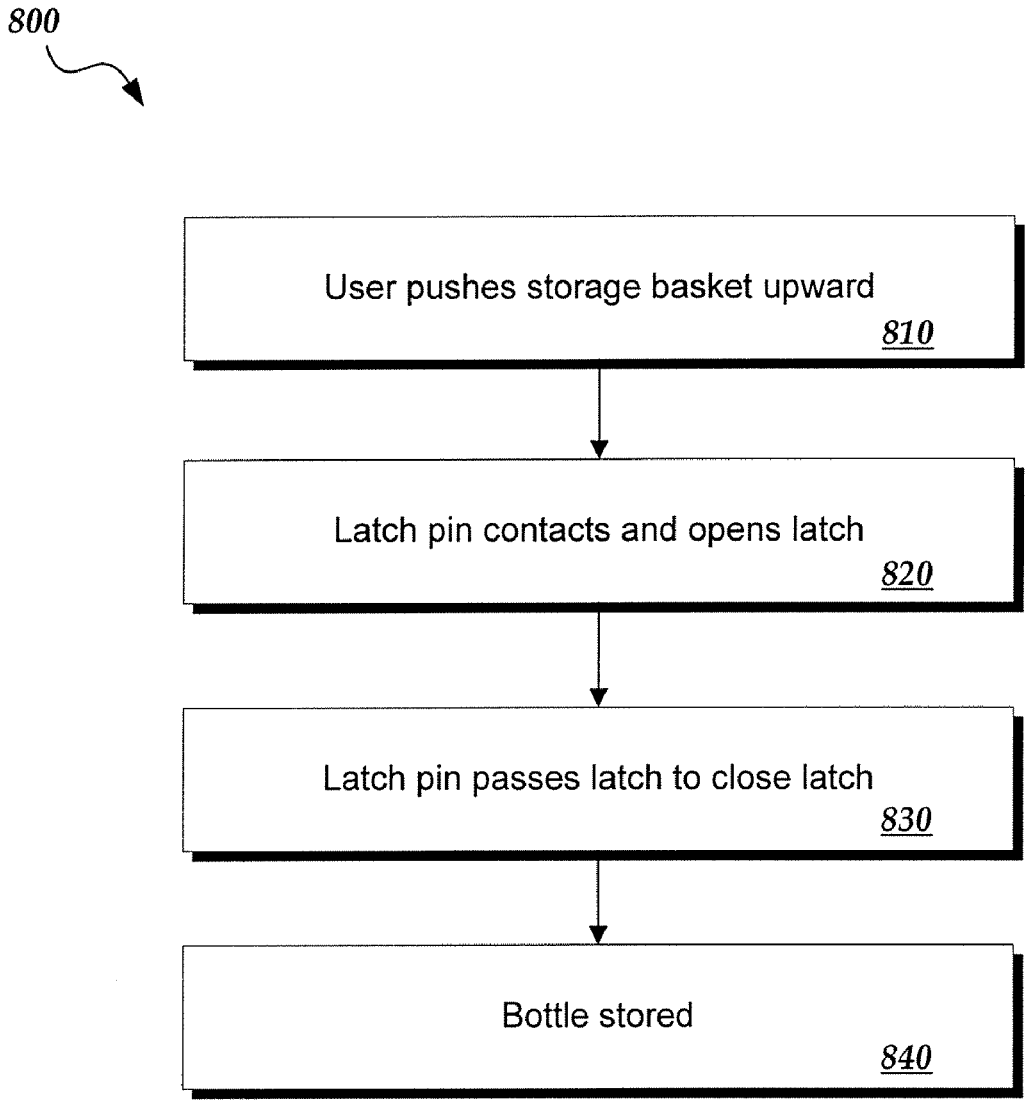
FIG. 8 is a flow diagram illustrating another process for storing a bottle when a bottle holder is in an access position.

FIG. 8 shows a diagram 800 of a method of storing the bottle 130 when the bottle holder 110 is in the access position shown in FIG. 2A. At 810, a user pushes the storage basket 210 in an upward direction. In one embodiment, while the user is pushing the storage basket 210, one or more multi-segmented arm assemblies 300 maintain the angle of the storage basket relative to the litter 124 as previously described with reference to FIG. 3.

At 820, the latch pin 218 reaches the latch 210. As the user continues to push the storage basket 210, the latch pin 218 presses against the angled surface 470 of the latch 410, thereby driving the latch system 250 open as described with reference to FIG. 4.

At 830, the latch pin 218 passes the latch 410, causing the latch 410 to slide back to its latched position and secure the latch pin 218 from beneath the latch pin 218. At 840, once the latching system 250 is latched, the latch 410 then holds the storage basket in the closed position and the bottle 130 is safely stored as shown in FIG. 2C.

The above specification, examples and data provide a complete description of the manufacture and use of the composition of the invention. Since many embodiments of the invention can be made without departing from the spirit and scope of the invention, the scope of the invention is limited only by claims with reference to descriptions of the invention.

I claim:

1. An apparatus comprising:

a mounting bracket configured to be secured to an underside of a litter;

a storage basket configured to receive a bottle;

a movable mechanism coupling the storage basket to the mounting bracket, the movable mechanism being configured for:

allowing the storage basket to be selectively positioned in an access position by a user, wherein the storage basket is positioned relatively away from the litter to provide the user with access to the bottle; and allowing the storage basket to be selectively positioned in a storage position by a user, wherein the storage basket is positioned relatively toward the underside of the litter to restrict movement of the bottle; and a latch system to hold the storage basket in the storage position.

2. The apparatus of claim 1, wherein the storage basket is automatically leveled when it is selectively positioned between the access position and the storage position.

3. The apparatus of claim 2, wherein the movable mechanism includes a damper that dampens the movement of the storage basket such that the bottle automatically remains in the storage basket when selectively moved between the storage position and the access position.

4. The apparatus of claim 2, wherein the movable mechanism includes:

a first linkage with a first end coupled to the mounting bracket and a second end coupled to the storage basket;

a second linkage with a first end coupled to the mounting bracket and a second end; and a third linkage with a first end coupled to the second end of the first linkage and a second end coupled to the second end of the second linkage, and further coupled to the storage basket.

5. The apparatus of claim 4, wherein the first end of the first linkage is rotationally coupled to a first portion of the mounting bracket, and the first end of the second linkage is rotationally coupled to a second portion of the mounting bracket such that the first linkage and the second linkage rotate about different centers of rotation.

6. The apparatus of claim 4, wherein the first linkage is of a first length and the second linkage is of a second length, wherein the first length is different from the second length.

7. The apparatus of claim 4, wherein the third linkage is coupled to the storage basket such that rotation of the storage basket relative to the third linkage is restrained.

8. The apparatus of claim 4, wherein the second end of the first linkage is rotationally coupled to the storage basket.

9. The apparatus of claim 4, wherein the first end of the third linkage is rotationally coupled to the second end of the first linkage, and the second end of the third linkage is rotationally coupled to the second end of the second linkage.

10. The apparatus of claim 9, wherein an angle of the third linkage relative to the litter is responsive to the position of the second end of the first linkage and the position of the second end of the second linkage, and an angle of the storage basket relative to the litter is response to the angle of the third linkage relative to the litter.

11. A system comprising:

a stretcher including a litter portion for carrying a patient;

a storage basket for carrying a bottle; and a mechanical coupling device that couples the storage basket to the litter portion, wherein a first portion of the mechanical coupling device is coupled to the litter portion and a second portion of the mechanical coupling device is coupled to the storage basket, and wherein the mechanical coupling device allows selective movement of the storage basket during use between an access position wherein the storage basket is positioned relatively away from the litter portion to provide the user with access to the bottle, and a storage position wherein the storage basket is positioned relatively toward the underside of the litter portion to restrict movement of the bottle.

12. The system of claim 11, wherein the storage basket includes an opened upper portion and when the storage basket is in the storage position, the opened upper portion is located proximate to the litter portion of the stretcher such that the litter portion of the stretcher constrains upward motion of the bottle.

13. The system of claim 12, wherein the second portion of the mechanical coupling device includes:

a first linkage rotationally coupled to the first portion of the mechanical coupling device at a first position; and a second linkage rotationally coupled to the first portion of the mechanical coupling device at a second position such that the first and second linkages rotate about different centers of rotation.

14. The system of claim 13, wherein an angle of the storage basket relative to the litter portion is responsive to the relative orientation of the first linkage and the second linkage.

15. The system of claim 13, wherein the relative orientation of the first linkage and the second linkage automatically levels the storage basket during movement of the mechanical coupling device.

16. A method for accessing a storage basket coupled to a mounting portion on a stretcher, comprising:

unlatching a latch that secures the storage basket in a storage position wherein the storage basket is positioned toward the stretcher;

moving the storage basket from the storage position to an access position by lowering the storage basket away from the stretcher relative to the storage position, wherein an upper portion of the storage basket is opened such that a bottle positioned in the storage basket may be accessed when the storage basket is in the access position; and dampening the motion of the storage basket as it is moved from the storage position to the access position.

17. The method of claim 16, wherein moving the storage basket includes automatically leveling the storage basket.

18. The method of claim 17, wherein automatically leveling the storage basket further includes:

rotating a first linkage about a first center of rotation, wherein the position of the first center of rotation is fixed relative to the stretcher; and rotating a second linkage about a second center of rotation, wherein the position of the second center of rotation is fixed relative to the stretcher and the position of the first center of rotation and the second center of rotation are different.

19. The method of claim 18, wherein automatically leveling the storage basket further includes rotating a third linkage about a first rotational joint that is coupled to the first linkage and about a second rotational joint that is coupled to the second linkage.

20. The method of claim 19, wherein automatically leveling the storage basket further includes holding an angle of the storage basket relative to the third linkage constant and holding a position of the storage basket relative to the third linkage constant as the first linkage and the second linkage are rotated.

* * * * *